United States Patent [19]

Gray

[11] Patent Number: 5,048,152

[45] Date of Patent: Sep. 17, 1991

[54] UMBRELLA HANDLE

[75] Inventor: Martin Gray, Sheffield, United Kingdom

[73] Assignee: Hoyland Fox Limited, Sheffield, England

[21] Appl. No.: 468,001

[22] Filed: Jan. 22, 1990

[30] Foreign Application Priority Data

Jan. 24, 1989 [GB] United Kingdom ..... 8901472

[51] Int. Cl.[5] ..... A47B 95/02

[52] U.S. Cl. ..... 16/110 R; 16/DIG. 19; 16/DIG. 24; 135/44

[58] Field of Search ..... 16/110 R, 111 R, DIG. 12, DIG. 19, DIG. 24, DIG. 25, DIG. 41; 135/44, 48, 37, 36 RT

[56] References Cited

U.S. PATENT DOCUMENTS 1,042,417 10/1912 Erickson ..... 135/44

3,882,880 5/1975 Waltz ..... 135/44

FOREIGN PATENT DOCUMENTS 345412 3/1931 United Kingdom ..... 135/44

619692 7/1947 United Kingdom ..... 135/44

*Primary Examiner*—Richard K. Seidel

*Assistant Examiner*—Patty E. Hong

*Attorney, Agent, or Firm*—Antonelli, Terry, Stout & Kraus

[57] ABSTRACT

An umbrella handle has an aperture at one end into which an umbrella shaft can be inserted. The handle has a sleeve-shaped integral axial extension on the shaft side for receiving a tip-cup to be slidably mounted thereon, the sleeve having an abutment over which a tip-cup can be passed before assembly of the handle to an umbrella shaft, to prevent the tip-cup sliding off the extension along the shaft after assembly.

9 Claims, 2 Drawing Sheets

UMBRELLA HANDLE

FIELD OF THE INVENTION

The invention relates to handles and handle assemblies for umbrella frames.

DESCRIPTION OF THE PRIOR ART

Umbrellas of the kind having a handle, a shaft and several ribs and stretchers supporting the cover, in which the ribs fold down on to the shaft when the umbrella is not in use, usually also have a "tip-cup", i.e. an annular recesses retainer slidably mounted on the shaft next to the handle to hold the (usually beaded) tips of the ribs close to the shaft. The tip-cup can be slid axially up the shaft when it is desired to retain the tips of the ribs in the folded-down condition and down towards the handle to free the rib ends for unfolding or erecting the umbrella.

So that the tip-cup does not slide further up the shaft when the umbrella is unfolded, there must be some means for limiting the movement of the tip-cup to the region of the handle. In some umbrellas this is done by deforming the shaft slightly at a location a few centimeters from the handle so that the tip-cup cannot pass beyond that point. However, this is unsatisfactory because the tip-cup slides directly on the shaft, and it is difficult to ensure that it can slide over the required small distance for engaging or disengaging the rib tips with just the right clearance on the shaft so that the tip-cup is reliably retained whilst holding the tips; often it is prone to slip off again while the umbrella is folded, leading to spreading of the ribs and partial opening of the cover, causing some inconvenience to the user.

Another prior art construction uses an additional metal sleeve part, fixed to the shaft adjacent the handle, for the tip-cup to slide on. This ensures a correct clearance and good sliding behaviour for the tip-cup; a flange on the sleeve at the end away from the handle ensures that the cup remains on the sleeve. However, the use of an additional part is obviously undesirable from a manufacturing point of view.

SUMMARY OF THE INVENTION

According to the invention there is provided an umbrella handle into which a shaft can be inserted, the handle having a sleeve-shaped integral axial extension on the shaft side for receiving a tip-cup to be slidably mounted thereon, the sleeve having an abutment over which a tip-cup can be passed before assembly of the handle to an umbrella shaft, to prevent the tip-cup sliding off the extension after assembly.

Conveniently, the abutment may be afforded by an outwardly protruding portion, for example an annular or part-annular lip integral with the end of the sleeve extension.

For ease of assembly the sleeve may be slit in the longitudinal direction so as to form two or more tongues, the free ends of which can be radially compressed slightly to allow the tip-cup to be slid on to it before the shaft is inserted into the handle when the tongues will be kept apart by the shaft thereby ensuring that the tip-cup is held captive on the sleeve. The sleeve may further have an integral pip or collar at an intermediate point along its length so as to provide additional retention for the tip-cup in its forward position i.e. when holding the umbrella tips closed.

The handle according to the invention may conveniently be moulded in one piece integrally with the smaller diameter sleeve extension from moldable plastics, though in other embodiments the extension could be made by machining.

Assembly of an umbrella handle with the shaft is simplified. All that needs to be done is to compress the sleeve slightly, slide an appropriately sized tip-cup onto the sleeve and then assemble the handle onto the shaft. The invention also comprises a handle as defined, with a tip-cup for it; and such a handle assembly when mounted on an umbrella shaft as part of an umbrella frame.

DETAILED DESCRIPTION

Figure 1:
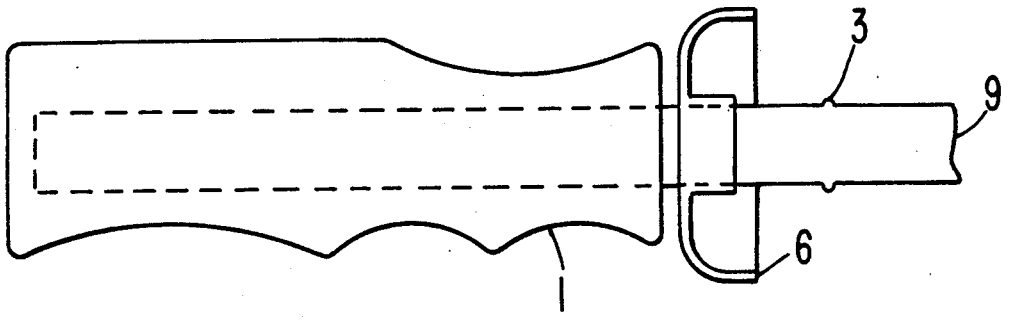
FIG. 1 (PRIOR ART)
FIG. 1 shows a first prior art umbrella handle assembly.

FIG. 1 shows a known handle assembly consisting of a handle 1 into which a shaft 9 is inserted, the shaft being deformed at a location 3 a short distance from the upper end of the handle. A tip-cup 6 slides axially on the shaft between the end of the handle and the deformation 3; the tip cup 6 naturally has to be fitted on the shaft before the latter is inserted in the handle. The cup 6 is prone to being too loose for effective operation or too tight for convenience of use, depending on the actual diameter of the shaft, particularly if the latter is painted with a layer of a thickness which is variable or difficult to control.

Figure 2:
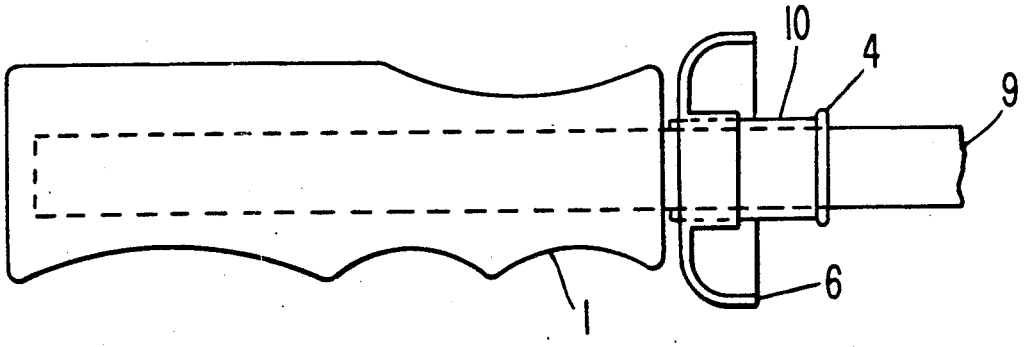
FIG. 2 (PRIOR ART)
FIG. 2 shows a second prior art umbrella handle assembly.

FIG. 2 shows another known arrangement where an additional sleeve 10 is provided, secured to the shaft 9 at the end of the handle 1. The sleeve 10 has a flange or lip 4 at end portion thereof facing away from the handle 1 so as to retain the tip-cup 6 after assembly. The provision of an additional part complicates the manufacturing process, though the frictional sliding engagement of the tip-cup on the sleeve 10 can be controlled better.

Figure 3:
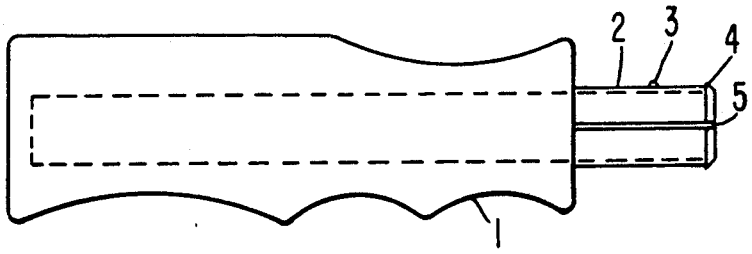
FIGS. 3 and 3*a* show an embodiment of the invention.

FIG. 3 shows a handle in accordance with the invention. The main part of the handle is made of plastics material and has a conventional shape but its upper end i.e. the end opposite the handle 1 of the umbrella has an integral sleeve 2 through which the shaft can pass. The sleeve terminates in a slight lip 4 forming an abutment for retaining a tip-cup, and it is axially slit to form slots 5 so that the free ends of the sections or tongues can be slightly compressed radially during assembly in order to allow the tip-cup to pass over the lip portions 4 onto the sleeve before inserting the shaft into the handle through the sleeve. When assembled in this way, the abutment lip 4 cannot again be compressed owing to the presence of the shaft inside the sleeve 2, and the abutment lip 4 thus prevents the tip-cup sliding off the sleeve 2.

Figure 3A:
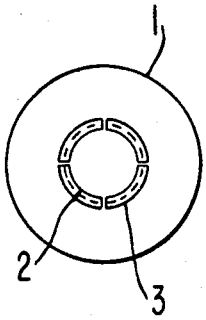

FIG. 3A shows an end view of the sleeve and handle. As can be seen, there are four axial slots which provide four arcuate tongues, though it will be appreciated that there could alternatively be only two or three slots and tongues, or more than four. Conceivably a sleeve with merely one slot could be used if it could be closed sufficiently to reduce the lip diameter to allow the hole in the tip-cup to fit over it.

Figure 4:
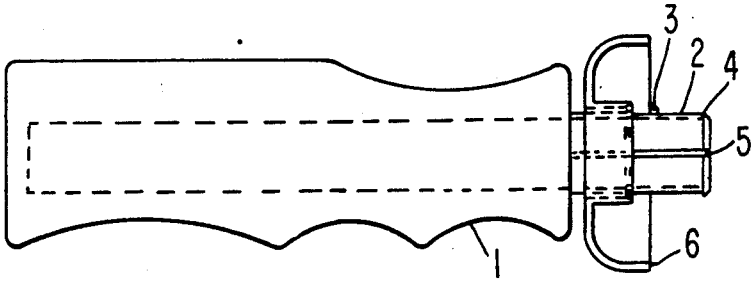
FIG. 4 shows a handle according to FIG. 3 with a tip-cup mounted on the sleeve.
Figure 5:
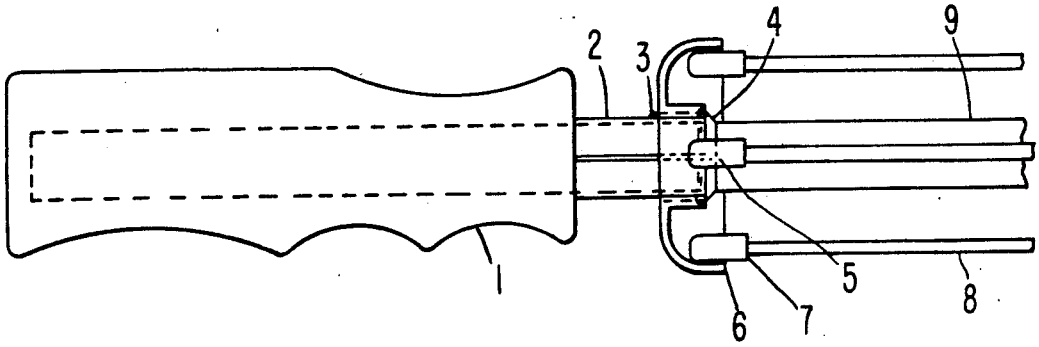
FIG. 5 shows the handle of FIG. 4 with the tip-cup pushed into the tip retaining position.

As FIG. 4 shows, when the tip-cup 6 is mounted on the sleeve the tip-cup can slide on the sleeve a short distance defined between a lower position adjacent the handle proper and the upper position defined by the lip 4. Since the sleeve is moulded integrally with the handle, the tolerance required for sliding can be easily maintained. In this embodiment the sleeve has a small protrusion or pip 3 which normally confines the tip-cup 6 to one or other part of the sleeve because the tip-cup can only pass over the pip 3 using slight pressure and it will not inadvertently freely slide over the pip. As FIG. 5 shows, when the umbrella is to be kept in the furled condition the pip 3 provides additional retaining means for the cup, ensuring that the tip-cup does not unintentionally slip off the rib tips and release the ribs 8. The user can, however, easily slide the cup 6 over the pip 3 when the umbrella is to be put up.

A significant advantage of a handle in accordance with the invention is that it can be moulded in one piece from any suitable mouldable plastics material with the sleeve for the tip-cup formed integrally during moulding. Conceivably it would be possible to make a handle according to the invention other than by moulding, e.g. by machining from wood, metal or plastics, and in that respect the invention is applicable to any type or shape of umbrella handle. In that case, before or after forming the axial hole for receiving the shaft, the sleeve would simply be machined by turning it down to a smaller diameter, leaving the end lip, and then cutting the axial slots.

Whether moulded or manufactured in other ways the axial slots need not extend the full axial extent of the sleeve provided they are long enough to allow the lipped end to be compressed.

The sleeve need not necessarily be radially compressible by means of such slots; other means could be provided for allowing the tip-cup to be slid onto the sleeve and keep it from sliding off, e.g. by resilience of the sleeve or tip-cup itself.

Where the abutment is constituted by a lip as shown, it need not be present all round the sleeve end in the form of an annulus; one or more part-annular portions would do. In other embodiments, the abutment could be at minimum just one protrusion, or two diametrically opposite protrusions, could suffice.

I claim:

1. An umbrella handle into which a shaft can be inserted, the handle having a sleeve-shaped integral axial extension on the shaft side for receiving a tip-cup to be slidably mounted thereon, wherein the axial stop along the extension has an abutment formed in one piece with the axial extension for preventing the tip-cup from sliding off the extension after assembly of the handle to the shaft, and wherein said extension is radially elastically compressible so as to allow the tip-cup to pass over the abutment and onto the extension prior to the assembly of the handle to the shaft.

2. An umbrella handle according to claim 1, wherein the abutment comprises a portion of said axial extension protruding radially outwardly from a free end of the axial extension.

3. An umbrella handle according to claim 2, wherein the abutment is an annular or part-annular lip integrally formed in one piece with the free end of the axial extension.

4. An umbrella handle into which a shaft can be inserted, the handle having a sleeve-shaped integral axial extension on the shaft side for receiving a tip-cup to be slidably mounted thereon, the extension includes an abutment for preventing the tip-cup from sliding off the extension after assembly of the handle to the shaft, and wherein the axial extension is split in a longitudinal direction thereof so as to form a plurality of tongues having free ends so as to enable the sleeve to be slightly radially compressible and to allow the tip-cup to be slid on to the axial extension prior to an insertion of the shaft into the handle.

5. An umbrella handle into which a shaft can be inserted, the handle having a sleeve-shaped integral axial extension on the shaft side for receiving a tip-cup to be slidably mounted thereon, the axial extension includes an abutment for preventing the tip-cup from sliding off the extension after assembly of the handle to the shaft and an integral pip or collar at an intermediate point along a length thereof so as to provide additional retention for the tip-cup when the tip-cup is in a tip-retaining position, and wherein said axial extension is radially compressible so as to allow the tip-cup to pass over the abutment and onto the extension prior to the assembly of the handle to the shaft.

6. An umbrella handle comprising:

an umbrella shaft insertable into said handle;

a sleeve-shaped integral axial extension provided on a shaft side of said handle;

a tip-cup slidably mounted on said extension;

an abutment provided on said extension for preventing the tip-cup from sliding off the extension after assembly of the handle to the umbrella shaft;

at least one small integral protrusion provided on said extension at an intermediate point along a length thereof so as to retain the tip-cup in a tip retaining position;

wherein said extension is slidably compressible so as to allow the tip-cup to pass over the abutment onto the extension prior to assembly of the handle to the umbrella shaft, and wherein the tip-cup is mountable on the extension by compressing a free-end of the extension, and, when mounted, the tip-cup is slidable over the protrusion with a slight pressure.

7. An umbrella handle according to claim 1, wherein the handle is made of mouldable plastics material.

8. An umbrella handle into which a shaft can be inserted, the handle having a sleeve-shaped integral axial extension on the shaft side for receiving a tip-cup to be slidably mounted thereon, the extension having an abutment over which a tip-cup can be passed before assembly of the handle to the shaft to prevent the tip-cup from sliding off the extension after the assembly, wherein the extension is split in a longitudinal direction thereof so as to form a plurality of tongues having free ends so as to enable the sleeve to be slightly radially compressible to allow the tip-cup to be slid onto the extension prior to an insertion of the shaft into the handle.

9. An umbrella handle into which a shaft can be inserted, the handle having a sleeve-shaped integral axial extension on the shaft side for receiving a tip-cup to be slidably mounted thereon, the extension has an abutment over which a tip-cup can be passed before assembly of the handle to the shaft to prevent the tip-cup from sliding off the extension after assembly, and wherein the sleeve has an integral small protrusion at an intermediate point along a length thereof so as to provide additional retention for the tip-cup in a tip-retaining position.

* * * * *